US005512135A

United States Patent [19]

Carré et al.

[11] Patent Number: 5,512,135

[45] Date of Patent: Apr. 30, 1996

[54] PROCESS FOR THE PRODUCTION OF PAPER

[75] Inventors: Bruno Carré, Grenoble, France; Ulf Carlson, Billdal, Sweden

[73] Assignee: Eka Nobel AB, Bohus, Sweden

[21] Appl. No.: 178,264

[22] PCT Filed: Jun. 12, 1992

[86] PCT No.: PCT/SE92/00417

§ 371 Date: Jan. 3, 1994

§ 102(e) Date: Jan. 3, 1994

[87] PCT Pub. No.: WO93/01353

PCT Pub. Date: Jan. 21, 1993

[30] Foreign Application Priority Data

Jul. 2, 1991 [SE] Sweden ..... 9102053
Jun. 1, 1992 [SE] Sweden ..... 9201700

[51] Int. Cl.[6] ..... D21H 21/06

[52] U.S. Cl. ..... 162/175; 162/181.2; 162/181.3; 162/181.5; 162/183

[58] Field of Search ..... 162/175, 181.2, 162/181.3, 183, 181.5

[56] References Cited

U.S. PATENT DOCUMENTS

| | | | |
|---|---|---|---|
| Re. 19,528 | 4/1935 | Rafton | 162/175 |
| 1,803,650 | 5/1931 | Rafton | 162/175 |
| 2,147,213 | 2/1939 | Pattilloch | 162/175 |
| 2,195,600 | 4/1940 | Reilly | 162/175 |
| 4,094,736 | 6/1978 | Malden | 162/175 |
| 4,115,187 | 9/1978 | Davidson | 162/181.3 |
| 4,299,654 | 11/1981 | Tlach et al. | 162/175 |
| 4,487,657 | 12/1984 | Gomez | 162/175 |

FOREIGN PATENT DOCUMENTS

| | | | |
|---|---|---|---|
| 1282551 | 7/1972 | United Kingdom | 162/181.3 |

OTHER PUBLICATIONS

P. H. Brouwer, "The relationship between zeta potential and ionic demand and how it affects wet-end retention", Retention, Jan. 1991, Tappi Journal, pp. 170–179.

R. M. Trksak, "Aluminum compounds as cationic donors in alkaline papermaking systems", 1990 Papermakers Conference, pp. 229–237.

P. G. Stoutjesdijk et al., "Einsatz von kationischer Stärke bei der Papierherstellung", Wochenblatt for Papierfabrikation, No. 23/24, 1975, pp. 897–901.

Wållberg et al., "Tips till papersmakaren: Bättre retention—mindre korrosion", Svensk Papperstidning No. 5, 1986, pp. 22–25.

*Primary Examiner*—Peter Chin

*Attorney, Agent, or Firm*—Burns, Doane, Swecker & Mathis

[57] ABSTRACT

The present invention relates to a process for improved dewatering and retention in the production of paper, where an anionic retention agent based on starches, cellulose derivatives or guar gums having no cationic groups and an acidic solution of an aluminum compound are added to the stock containing lignocellulose-containing fibres and optionally fillers. The pH of the stock prior to the addition of the aluminium compound should be at least about 6 to obtain the desired cationic aluminium hydroxide complexes in the stock. The present invention is cost effective and insensitive to the content of calcium in the white water.

12 Claims, No Drawings

PROCESS FOR THE PRODUCTION OF PAPER

BACKGROUND

In the production of paper, a stock consisting of papermaking fibres, water and normally one or more additives is brought to the headbox of the paper machine. The headbox distributes the stock evenly across the width of the wire, so that a uniform paper web can be formed by dewatering pressing and drying. The pH of the stock is important for the possibility to produce certain paper qualities and for the choice of additives. A large number of paper mills throughout the world have changed, in the last decade, from acidic stocks to neutral or alkaline conditions. This is inter alia due to the possibility to use calcium carbonate as filler, which produces a highly white paper at a very competitive price.

In the production of paper, improved dewatering and retention are desired. Improved dewatering (drainage) means that the speed of the paper machine can be increased and/or the energy consumption reduced in the following pressing and drying sections. Furthermore, improved retention of fines, fillers, sizing agents and other additives will reduce the amounts added and simplify the recycling of white water.

Fibres and most fillers—the major papermaking components—carry a negative surface charge by nature, i.e. they are anionic. It is previously known to improve the dewatering and retention effect by altering the net value and distribution of these charges. Commonly, starch where cationic groups have been introduced, has been added to the stock because of its strong attraction to the anionic cellulose-containing fibres. This effect has, however, been reduced in mills where the white water is hard, due to the competition for the anionic sites between the cationic starch and calcium ions. For most effective results, has been thought that there must be a suitable balance between cationic and anionic groups in the starch. Starches, where both cationic and anionic groups are introduced are termed amphoteric and are well known in papermaking.

It is previously known to combine cationic potato starch or amphoteric starch with aluminium compounds to further improve the effect. In R. Trksak, Tappi Papermakers Conference 1990, pp. 229–237 systems of cationic potato starch or amphoteric maize starch and polyaluminium chloride PAC), alum or aluminium chloride are used to improve the drainage and retention under alkaline conditions. In P. H. Brouwer, Tappi Journal, 74(1), pp. 170–179 (1991) alum is combined with anionic starch to improve the dewatering as well as gloss and strength of packaging paper. In this case the pH of the pulp as well as the white water is 4.4 and the addition of alum 50 kg/ton of pulp.

The Invention

The invention relates to a process for improved dewatering and retention of fines, fillers, sizing agents and other additives in the production of paper, where an anionic retention agent having no cationic groups and an acidic solution of an aluminium compound are added to the stock of lignocellulose-containing fibres.

The invention thus concerns a process for the production of paper on a wire by forming and dewatering a stock of lignocellulose-containing fibres, and optional fillers, whereby an anionic retention agent based on starches, cellulose derivatives or guar gums having no cationic groups and an acidic solution of an aluminium compound are added to the stock, which stock prior to the addition of the aluminium compound has a pH in the range of from about 6 up to about 11.

According to the present invention it has been found that by adding an acidic solution containing an aluminium compound to a stock with a pH of at least about 6, it is possible to get an interaction between the cationic aluminium hydroxide complexes developed in the stock and the anionic groups of the retention agent and cellulose fibres.

As stated above, conventionally starch where cationic groups have been introduced is used in papermaking. It is advantageous, however, to use anionic starch since it is much easier and less expensive to introduce anionic groups, such as phosphate groups, than it is to introduce cationic ones, such as tertiary amino or quaternary ammonium groups. According to the present invention it has been found that an anionic retention agent, which is suitably an anionic starch, having no cationic groups in combination with an acidic solution containing an aluminium compound, gives improved and cost effective dewatering and retention in neutral or alkaline stocks.

The components can be added to the stock in arbitrary order. Preferably the cationic aluminium hydroxide complexes are developed in the presence of lignocellulose-containing fibres. Therefore, the invention especially relates to addition of a retention agent and an aluminium compound to a stock of lignocellulose-containing fibres, where the addition is separated from the addition of an optional filler. Preferably also, the addition of retention agent is separated from the addition of aluminium compound to the stock. A considerable improvement, in comparison with prior art technique, is obtained when the anionic retention agent having no cationic groups is first added and then the acidic solution containing an aluminium compound. However, the best effect is obtained if the aluminium compound is first added to the stock followed by the anionic retention agent. when a cationic inorganic colloid is added to the stock in addition to the aluminium compound and the anionic retention agent is suitable to add said colloid after the addition of the aluminium compound. Preferably the aluminium compound is added first followed by the retention agent and as the third component the cationic inorganic colloid.

An anionic retention agent used in the present process is based on a polysaccharide from groups of starches, cellulose derivatives or guar gums. The anionic retention agent having no cationic groups, contains negatively charged (anionic) groups and no introduced cationic groups. The cellulose derivatives are e.g. carboxyalkyl celluloses such as carboxymethyl cellulose (CMC). Suitably the anionic retention agent is an anionic starch. Although the advantages of the present invention can be obtained with any of the anionic retention agents based on a polysaccharide having no cationic groups, the present invention will be described in the following specification with respect to the use of anionic starch.

The anionic groups, which can be native or introduced by chemical treatment, are suitably phosphate, phosphonate, sulphate, sulphonate or carboxylic acid groups. Preferably the groups are phosphate ones due to the relatively low cost to introduce such groups. Furthermore, the high anionic charge density of the phosphate groups increases the reactivity towards the cationic aluminium hydroxide complexes.

The amount of anionic groups, especially the phosphate ones, in the starch influences the dewatering and retention effect. The overall content of phosphorus in the starch is a poor measure of the anionic groups, since the phosphorus is inherent in the covalently bonded phosphate groups as well as in the lipids. The lipids are a number of fatty substances, where in the case of starch, the phospholipids and especially the lysophospholipids are important. The content of phosphorus, thus, relates to the phosphorus in the phosphate groups covalently bonded to the amylopectin of the starch. Suitably the content of phosphorus lies in the range of from about 0.01 up to about 1% phosphorus on dry substance the upper limit is not critical but has been chosen for economic reasons. Preferably the content lies in the range of from 0.04 up to 0.4% phosphorus on dry substance.

The anionic starch can be produced from agricultural products such as potatoes, corn, barley, wheat, tapioca, manioc, sorghum or rice or from refined products such as waxy maize. The anionic groups are native or introduced by chemical treatment. Suitably potato starch is used. Preferably native potato starch is used, since it contains an appreciable amount of covalently bonded phosphate monoester groups (between about 0.06 and about 0.1% phosphorus on dry substance) and the lipid content is very low (about 0.05% on dry substance). Another preferred embodiment of the invention is to use phosphated potato starch.

The aluminium compound used according to the present invention is per se previously known for use in papermaking. Any aluminium compound which can be hydrolyzed to cationic aluminium hydroxide complexes in the stock can be used. Suitably the aluminium compound is alum, aluminium chloride, aluminium nitrate or a polyaluminium compound. The polyaluminium compounds exhibit a more pronounced intensity and stability of the cationic charge under neutral or alkaline conditions, than does alum, aluminium chloride and aluminium nitrate. Therefore, preferably the aluminium compound is a polyaluminium compound.

As an example of suitable compounds can be mentioned molyaluminium compounds with the general formula $$Al_n(OH)_mX_{3n-m} \quad (I)$$

wherein

X is a negative ion such as $Cl^-$, $NO_3^-$ or $CH_3COO^-$, and each of n and m are positive numbers such that 3n−m is greater than 0

Preferably X is $Cl^-$ and such polyaluminium compounds are known as polyaluminium chlorides (PAC). In aqueous solutions these compounds develop into polynuclear complexes of hydrolyzed aluminium ions, where the constitution of the complexes are dependent e.g. on the concentration and the pH.

The polyaluminium compound can also contain anions from sulphuric acid, phosphoric acid, polyphosphonic acid, chromic acid, bichromic acid, silicic acid, citric acid, oxalic acid, carboxylic acids or sulphonic acids. Preferably the additional artion is the sulphate ion. An example of preferred polyaluminium compounds containing sulphate, are polyaluminium chlorosulphates.

The polyaluminium compounds are termed basic, where the basicity is defined as the ratio $$Basicity=m/3n * 100 \quad (II)$$

wherein n and m are positive numbers according to formula I Suitably the basicity lies in the range of from 10 up to 90% and preferably in the range of from 20 up to 85%.

An example of a commercially available polyaluminium compound is Ekoflock produced and sold by Eka Nobel AB in Sweden. Here the basicity is about 25% and the content of sulphate and aluminium about 1.5 and 10% by weight, respectively, where the content of aluminium is calculated as $Al_2O_3$. In aqueous solutions the dominant complex is $Al_3(OH)_4^{5+}$ which on dilution to a smaller or greater degree is transformed into $Al_{13}O_4(OH)_{24}^{7+}$. Also non-hydrolyzed aluminium compounds such as $Al(H_2O)_6^{3+}$ are present.

Other examples of commercially available compounds of this type are the sulphate-free Sachtoklar(R) sold by Sachtleben Chemie in Germany, the sulphate containing WAC sold by Atochem in France and the highly basic polyaluminium chloride compound Locron sold by Hoechst AG in Germany.

The effect of the addition of the aluminium compound is very dependant on the pH of the stock as well as of the solution containing the aluminium compound. According to the invention, the addition of the aluminium compound at a pH of the stock in the range of from about 6 up to about 11 increases the dewatering speed and degree of retention markedly. Prior to the addition of the aluminium compound, the pH of the stock lies suitably in the range of from 6 up to 10 and more suitably in the range of from 6.5 up to 10. Prior to the addition of the aluminjure compound, the pH of the stock lies preferably in the range of from 6.5 up to 9.5 and more preferably in the range of from 7 up to 9.

Depending on the buffering effect of the stock, the pH of the stock after the addition of aluminium compound should be in the range from about 6 up to about 10. Suitably, after the addition of aluminium compound the pH of the stock lies in the range of from 6.5 up to 9.5. Preferably, after the addition of aluminjure compound the pH of the stock lies in the range of from 7 up to 9.

Where the stock is neutral or alkaline the pH in the solution containing the aluminium compound must be acidic so that the cationic aluminium hydroxide complexes can be developed at the addition to the stock. Suitably the pH of the solution is below about 5.5 and preferably the pH lies in the range of from 1 up to 5.

The cationic charge of the various aluminium hydroxide complexes developed decreases with time, an effect which is especially pronounced when the content of calcium in the white water is low. The loss of cationic character especially influences the retention of fines and additives but the dewatering is also influenced. Therefore, it is important that the aluminium compounds are added shortly before the stock enters the wire to form the paper. Suitably, the aluminium compound is added to the stock less than about 5 minutes before the stock enters the wire to form the paper. Preferably, the aluminium compound is added to the stock less than 2 minutes before the stock enters the wire to form the paper.

The amount of the anionic retention agent added can be in the range of from about 0.05 up to about 10 per cent by weight, based on dry fibres and optional fillers. Suitably the amount of the anionic retention agent lies in the range of from 0.1 up to 5 per cent by weight and preferably in the range of from 0.2 up to 3 per cent by weight, based on dry fibres and optional fillers.

The amount of aluminium compound added can be in the range from about 0.001 up to about 0.5 percent by weight, calculated as $Al_2O_3$ and based on dry fibres and optional fillers. Suitably the amount of aluminium compound lies in the range of from 0.001 up to 0.2 percent by weight, calculated as $Al_2O_3$ and based on dry fibres and optional fillers.

In paper mills where the content of calcium and/or magnesium ions in the white water is high, it is often difficult to produce efficiently paper of good quality. In papermaking, normally the content of magnesium is low, reducing the problem to comprise the presence of calcium ions only. In the case of white water these positive ions can have their origin in the tap water, in additives like gypsum and/or in the pulp, e.g. if a deinked one is used. The calcium ions are adsorbed onto the fibres, fines and fillers, thereby neutralizing the anionic sites. The result is restricted swelling of the fibres giving poor hydrogen bonding and thus paper of low strength. Furthermore, the effect of cationic dewatering and retention agents added is reduced since the possibility of electrostatic interaction has been restricted.

The present invention can be used in papermaking where the calcium content of the white water varies within wide limits. However, the improvement in dewatering and retention of fines and additives compared to prior art techniques increases with the calcium content, i.e. the present process is insensitive to high concentrations of calcium. Therefore, the present process is suitably used in papermaking where the white water obtained by dewatering the stock on the wire contains at least about 50 mg $Ca^{2+}$/– liter. Preferably the white water contains from 100 mg $Ca^{2+}$/liter and the system is still effective at a calcium content of 2000 mg $Ca^{2+}$/liter.

In paper production according to the invention, additives of conventional types can be added to the stock. Examples of such additives are fillers and sizing agents. Examples of fillers are chalk or calcium carbonate, China clay, kaolin, talcum, gypsum and titanium dioxide. Chalk or calcium carbonate has a buffering effect when the acidic solution containing the aluminium compound is added to the stock. This means that the decrease in pH will be low which is especially advantageous when developing the cationic aluminium hydroxide complexes. Preferably, therefore, calcium carbonate is used as filler when the stock is neutral or alkaline. The fillers are usually added in the form of a water slurry in conventional concentrations used for such fillers. Examples of sizing agents are alkylketene . dimer (AKD), alkyl or alkenyl succinic anhydride (ASA) and colophony rosin. Preferably, AKD is used as the sizing agent in combination with the present process.

In paper production according to the invention, also conventional cationic inorganic colloids can be added to the stock. The effect of such cationic colloids added is good even where the calcium content of the white water is high. The colloids are added to the stock as dispersions, commonly termed sols, which due to the large surface to volume ratio avoids sedimentation by gravity. The terms colloid and colloidal indicate very small particles. Examples of cationic inorganic colloids are aluminium oxide sols and surface modified silica based sols. Suitably the colloids are silica based sols. These sols can be prepared from commercial sols of colloidal silica and from silica sols consisting of polymeric silicic acid prepared by acidification of alkali metal silicate. The sols are reacted with a basic salt of a polyvalent metal, suitably aluminium, to give the sol particles a positive surface charge. Such colloids are described in the PCT application WO 89/00062.

The amount of cationic inorganic colloid added can be in the range of from about 0.005 up to about 1.0 per cent by weight, based on dry fibres and optional fillers. Suitably the amount of the cationic inorganic colloid lies in the range of from 0.005 up to 0.5 per cent by weight and preferably in the range of from 0.01 up to 0.2 per cent by weight, based on dry fibres and optional fillers.

The addition of the aluminium compound can also be divided into two batches, to counteract the influence of the so called anionic trash. The trash tend to neutralize added cationic compounds before they reach the surface of the anionic fibres, thereby reducing the intended dewatering and retention effect. Therefore, a part of the solution containing the aluminium compound can be added long before the stock enters the wire to form the paper, to have sufficient time to act as an anionic trash catcher (ATC). The rest of the solution is added shortly before the stock enters the wire, so as to develop and maintain the cationic aluminium hydroxide complexes which can interact with the anionic groups of the retention agent and cellulose fibres. For example, 30% of the amount of aluminium compound in the solution containing the aluminium compound can be used as an ATC and the remaining 70% of the amount of aluminium compound to form the cationic complexes.

Production of paper relates to production of paper, paperboard, board or pulp in the form of sheets or webs, by forming and dewatering a stock of lignocellulose-containing fibres on a wire. Sheets or webs of pulp are intended for subsequent production of paper after slushing of the dried sheets or webs. The sheets or webs of pulp are often free of additives, but dewatering or retention agents can be present during the production. Suitably, the present process is used for the production of paper, paperboard or board.

The present invention can be used in papermaking from different types of lignocellulose-containing fibres. The anionic retention agent and aluminium compound can for example be used as additives to stocks containing fibres from chemical pulps, digested according to the sulphite, sulphate, soda or organosolv process. Also, the components of the present invention can be used as additives to stocks containing fibres from chemical thermomechanical pulps (CTMP), thermomechanical pulps (TMP), refiner mechanical pulps, groundwood pulps or pulps from recycled fibres. The stock can also contain fibres from modifications of these processes and/or combinations of the pulps, and the wood can be softwood as well as hardwood. Suitably the invention is used in papermaking of stocks containing fibres from chemical pulps. Suitably, also, the fibre content of the stock is at least 50 percent by weight, calculated on dry substance.

The invention and its advantages are illustrated in more detail by the following examples which, however, are only intended to illustrate the invention and not to limit the same. The percentages and parts stated in the description, claims and examples, relate to percent by weight and parts by weight, respectively, unless otherwise stated.

Example 1

In the following tests the dewatering for stocks has been determined with a "Canadian Standard Freehess (CSF) Tester" according to SCAN-C 21:65, after the addition of the anionic retention agent and acidic solution containing an aluminium compound. The stock was agitated at 800 rpm when the components were added and the residence time for each component was throughout 45 seconds for the first one and 30 seconds for the second one. The pulp consistency was 0.3% by weight of dry substance. After addition of the components the flocculated stock was passed to the CSF tester and measurements made 35 seconds after the last addition. The collected water is a measure of the dewatering effect and given as ml CSF.

The collected water was very clear after the addition of the components showing that a good retention effect of the fines to the fibre flocks had been obtained by the process according to the invention.

The stock consisted of fibres from a sulphate pulp of 60% softwood and 40% hardwood refined to 200 ml CSF, with 30% of calcium carbonate as filler.

The polyaluminium chloride ( PAC ) used was Ekoflock from Eka Nobel AB in Sweden, with a basicity of about 25% and a sulphate and aluminium content of about 1.5 and 10% by weight, respectively, where the content of aluminium was calculated as $Al_2O_3$.

The pH of the solutions containing PAC and alum were about 1.7 and 2.5, respectively, as read from the pH meter.

The starches used were prepared by cooking at 95° C. for 20 minutes. The consistency of the starch solutions prior to the addition to the stock were 0.5% by weight in all experiments.

Table I shows the results from dewatering tests where PAC was added to the stock followed by native potato starch. The amount of PAC added, was 1.3 kg calculated as $Al_2O_3$ per ton of dry stock including the filler. The pH of the stock was about 8.6 before the addition of PAC and 8.4 after said addition. The calcium content was 20 mg/liter of white water. For comparison, tests were also carried out where the potato starch was replaced by starches without anionic groups. For further comparison, tests were also carried out where only native potato starch and native tapioca starch were added to the stock. Prior to the addition of the additives, the dewatering effect of the stock with filler was 225 ml CSF. The results in ml CSF are given below.

TABLE I

| Additives | Starch, kg/ton of dry stock | | |
|---|---|---|---|
| | 5 | 10 | 15 |
| NPS | 200 | 190 | 185 ml CSF |
| PAC + NPS (invention) | 275 | 345 | 365 ml CSF |
| NTS | 210 | 210 | 210 ml CSF |
| PAC + NTS | 230 | 235 | 215 ml CSF |
| PAC + NBS | 230 | 225 | 230 ml CSF |

wherein

NPS=native potato starch

NTS=native tapioca starch

NBS=native barley starch

PAC=polyaluminium chloride

As can be seen from Table I, the addition of PAC and native potato starch increases the dewatering as opposed to native potato starch alone. Also, the use of native potato starch with PAC is much more efficient than combinations of PAC and native tapioca or barley starch, which latter starch types have no anionic groups. The difference is especially pronounced when the amount of starch added is increased.

EXAMPLE 2

Table II shows the results from dewatering tests with the same stock as used in Example 1, where PAC or alum was added to the stock followed by native potato starch, or in the reverse order. The amount of PAC as well as alum added, was 1.3 kg calculated as $Al_2O_3$ per ton of dry stock including the filler. The pH of the stock was about 8.0 before the addition of PAC or alum and 7.8 after said addition. The calcium content was 160 mg/liter of white water. For comparison, tests were also carried out where the potato starch was replaced by native tapioca starch without anionic groups. Prior to the addition of the additives, the dewatering effect of the stock with filler was 240 ml CSF. The results in ml CSF are given below.

TABLE II

| Additives | Starch, kg/ton of dry stock | |
|---|---|---|
| | 10 | 15 |
| PAC + NPS | 430 | 490 ml CSF |
| NPS + PAC | 310 | 360 ml CSF |
| Alum + NPS | 435 | 460 ml CSF |
| NPS + Alum | 295 | 340 ml CSF |
| PAC + NTS (comp.) | 245 | 245 ml CSF |
| NTS + PAC (comp.) | 240 | 235 ml CSF |

wherein

PAC=polyaluminium chloride

Alum=aluminium sulphate

NPS=native potato starch

NTS=native tapioca starch

As can be seen from Table II, it is more efficient to add the aluminium compound before %he starch. This is valid for PAC as well as alum. Also, PAC is generally more efficient as regards dewatering than alum irrespective of order of addition. Furthermore, the use of native potato starch as the retention agent is more efficient than native tapioca starch.

EXAMPLE 3

Table III shows the results from dewatering tests with the same stock as used in Example 1, where PAC was added to the stock followed by native potato starch. The amount of PAC added, was 1.3 kg calculated as $Al_2O_3$ per ton of dry stock including the filler. The amount of starch added, was 15 kg per ton of dry stock including the filler. The pH of the stock was about 8.6 after addition of the carbonate, which dropped to between 8 and 7.5 when calcium chloride was added to increase the content of calcium to 160 and 640 mg/liter of white water, respectively. The pH of the stock after the addition of PAC was about 0.2 pH units lower than before said addition. For comparison, tests were also carried out where the potato starch was replaced by cationic tapioca starch. The tapioca starch was cationized to 0.25% N. For further comparison, only NPS was added to the stock in one series of experiments. The results in ml CSF are given below.

TABLE III

| Additives | Calcium content, mg/liter of white water | | |
|---|---|---|---|
| | 20 | 160 | 640 |
| Only stock | 225 | 240 | 255 ml CSF |
| NPS (comp.) | 185 | 205 | 215 ml CSF |
| PAC + NPS | 365 | 490 | 505 ml CSF |
| PAC + CTS (comp.) | 350 | — | 225 ml CSF |

wherein

PAC=polyaluminium chloride

NPS=native potato starch

CTS=cationic tapioca starch

As can be seen from Table III, the addition of native potato starch which contains anionic groups enhances the dewatering more than the addition of cationic tapioca starch. With the potato starch, the efficiency of the dewatering increases with the calcium content of the white water, whereas with the cationic tapioca starch the dewatering effect is dramatically reduced with an increase in the calcium content.

EXAMPLE 4

Table IV shows the results from dewatering tests with the same stock as used in Example 1, except that 30% of China clay was used as filler instead of calcium carbonate. PAC was added to the stock followed by native potato starch at a stock pH of 4.2, 8 or 9.8. The stock pH after the addition of PAC, was 4.2, 6.5 and 8.2, respectively. The amount of PAC added, was 1.3 kg calculated as $Al_2O_3$ per ton of dry stock including the filler. The amount of starch added, was 15 kg per ton of dry stock including the filler. The content of calcium was 20 mg/liter of white water. For comparison, only NPS was added to the stock in one series of experiments. The results in ml CSF are given below.

TABLE IV

| Additives | pH 4.2 | pH 8 | pH 9.8 |
|---|---|---|---|
| Only stock | 295 | 310 | 300 ml CSF |
| NPS (comp.) | 250 | 270 | 265 ml CSF |
| PAC + NPS | 260 | 325 | 480 ml CSF |

wherein

NPS=native potato starch

PAC=polyaluminium chloride

As can be seen from Table IV, the dewatering effect of the addition of PAC and native potato starch increases at a pH of 8 and 9.8, values which lie within the range of the present invention.

EXAMPLE 5

Table V shows the results from dewatering tests with the same stock as used in Example 1. Alum was added to the stock followed by native potato starch at a stock pH of 8. After the addition of alum the stock pH was 7.8. The amount of alum added, was 1.3 kg calculated as $Al_2O_3$ per ton of dry stock including the filler. The amount of starch added, was 5, 10 and 15 kg per ton of dry stock including the filler. The content of calcium was 20 mg/liter of white water. For comparison, alum was added to the stock before the native potato starch, at a stock pH of 4.5. After the addition of alum the stock pH was 4.3. At this low pH, calcium carbonate was replaced by China clay as filler. For further comparison, only native potato starch was added to the stock in one series of experiments. Prior to the addition of the additives, the dewatering effect of the stock with filler was 225 ml CSF at pH 8 and 300 ml CSF at pH 4.5. The results in ml CSF are given below as the difference between the results obtained after and before the addition of additives to the stocks.

TABLE V

| Additives | pH | Starch, kg/ton dry stock 5 | 10 | 15 |
|---|---|---|---|---|
| NPS (comp.) | 8 | −25 | −35 | −40 ml CSF |
| Alum + NPS | 8 | +20 | +85 | +100 ml CSF |
| Alum + NPS (comp.) | 4.5 | −25 | +5 | +5 ml CSF |

wherein

NPS=native potato starch

Alum=aluminium sulphate

As can be seen from Table V, the dewatering effect of the addition of alum and native potato starch is lower or essentially unaltered at a pH of 4.5, a value which is below the range of the present invention.

We claim:

1. A process for the production of paper on a wire by forming and dewatering a stock of lignocellulose-containing fibers, comprising the steps of:

(a) providing a stock of lignocellulose-containing fibers, said stock containing at least 50% by weight of said fibers, calculated on dry substance, and said stock having a pH in the range of from about 6 to about 11;

(b) adding an acidic solution of an aluminum compound to the stock of step (a) less than about 2 minutes before said stock enters the wire to form paper, and said aluminum compound being added to said stock in an amount of from 0.001 to 0.5% by weight, calculated as $Al_2O_3$ and based on dry fibers and optional fillers;

(c) adding an anionic retention agent free of cationic groups to the stock of step (a), said anionic retention agent being an anionic starch selected from the group consisting of phosphated starches and anionic potato starches, and said anionic retention agent being added to said stock in an amount of from 0.05 to 10% by weight, based on dry fibers and optional fillers; and (d) thereafter dewatering said stock on a wire, wherein the total amount of said aluminum compound is added to said stock prior to said anionic retention agent.

2. A process according to claim 1, including the step of adding at least one filler to the stock separately from said addition of anionic retention agent and said aluminum compound and prior to said stock entering on said wire.

3. A process according to claim 1, wherein the pH of the stock after the addition of the aluminum compound is from about 6 to about 10.

4. A process according to claim 1, wherein the anionic retention agent is native potato starch.

5. A process according to claim 1, wherein the aluminum compound is a polyaluminum compound.

6. A process according to claim 1, wherein the amount of the anionic retention agent added lies in the range of from 0.1 to 5 percent by weight, based on dry lignocellulosic fibers.

7. A process according to claim 1, wherein the stock, prior to the addition of the aluminum compound, has a pH of from 7 to 9.

8. A process according to claim 1, wherein the content of calcium ions in the white water obtained by dewatering the stock on the wire is at least about 50 mg $Ca^{2+}$/liter.

9. A process according to claim 2, wherein the aluminum compound and the fillers are added to the stock of lignocellulose-containing fibers before the anionic retention agent.

10. A process according to claim 2, wherein the amount of the anionic retention agent added lies in the range of from 0.1 to 5 percent by weight, based on the dry lignocellulose fibers and fillers.

11. A process according to claim 2, wherein the amount of the anionic retention agent added lies in the range of from 0.1 to 5 percent by weight, based on the dry lignocellulose fibers.

12. A process according to claim 4, wherein the amount of the anionic retention agent added lies in the range of from 0.1 to 5 percent by weight based on dry lignocellulose fibers.

* * * * *